US009074453B2

(12) United States Patent
Richard et al.

(10) Patent No.: US 9,074,453 B2
(45) Date of Patent: Jul. 7, 2015

(54) METHOD AND SYSTEM FOR HYDRAULIC FRACTURING

(76) Inventors: Bennett M. Richard, Kingwood, TX (US); Yang Xu, Houston, TX (US)

( * ) Notice: Subject to any disclaimer, the term of this patent is extended or adjusted under 35 U.S.C. 154(b) by 881 days.

(21) Appl. No.: 13/246,634

(22) Filed: Sep. 27, 2011

(65) Prior Publication Data

US 2012/0073819 A1 Mar. 29, 2012

Related U.S. Application Data

(63) Continuation-in-part of application No. 12/425,983, filed on Apr. 17, 2009, now Pat. No. 8,826,985.

(51) Int. Cl.

| | |
|---|---|
| ***E21B 43/26*** | (2006.01) |
| ***E21B 33/10*** | (2006.01) |
| ***E21B 34/14*** | (2006.01) |

(52) U.S. Cl.

CPC ..... *E21B 33/10* (2013.01); *E21B 34/14* (2013.01); *E21B 43/26* (2013.01)

(58) Field of Classification Search

CPC ..... E21B 43/26; E21B 43/261; E21B 33/10; E21B 34/06

USPC ..... 166/259, 281, 272.2, 308.1, 376, 373, 166/100, 177.5, 317, 318

See application file for complete search history.

(56) References Cited

U.S. PATENT DOCUMENTS

| | | | | |
|---|---|---|---|---|
| 3,062,294 | A * | 11/1962 | Huitt et al. | 166/177.5 |
| 3,242,988 | A | 3/1966 | McGuire et al. | |
| 3,245,472 | A | 4/1966 | Zandmer | |
| 3,312,280 | A * | 4/1967 | Koplin | 166/285 |
| 3,347,317 | A | 10/1967 | Zandmer | |
| 4,285,398 | A | 8/1981 | Zandmer | |
| 4,475,729 | A | 10/1984 | Costigan | |
| 5,224,556 | A * | 7/1993 | Wilson et al. | 175/4.53 |
| 5,425,424 | A | 6/1995 | Reinhardt et al. | |
| 5,479,986 | A | 1/1996 | Gano et al. | |
| 6,755,249 | B2 * | 6/2004 | Robison et al. | 166/262 |
| 7,267,172 | B2 | 9/2007 | Hofman | |

(Continued)

OTHER PUBLICATIONS

Hill, Leo El., et al., "Completion Tools Proven Successful in Deepwter Frac Packs and Horizontal Gravel-Packing", IADC/SPE 74492, Feb. 2002, 1-15.

(Continued)

*Primary Examiner* — James G Sayre

(74) *Attorney, Agent, or Firm* — Norton Rose Fulbright US LLP

(57) ABSTRACT

A fracturing operation is done in open hole without annular space isolation. The annular space is spanned by extendable members that are located behind isolation valves. The extendable members can comprise a biodegradable plug that allows extension of the extendable members by application of pressure. With the plug remained in place, additional pressure can be delivered until at least a portion of the degradable material is pushed onto the surface of the formation. At least a portion of the pushed degradable material provides a seal between the end of the extendable members and the surface of the formation to allow pressure to build until the formation frac gradient is exceeded and the formation is fraced.

20 Claims, 5 Drawing Sheets

(56) References Cited

U.S. PATENT DOCUMENTS

| | | | | |
|---|---|---|---|---|
| 7,387,158 | B2 | 6/2008 | Murray et al. | |
| 7,387,165 | B2 | 6/2008 | Lopez de Cardenas et al. | |
| 7,392,841 | B2 | 7/2008 | Murray et al. | |
| 7,422,058 | B2 | 9/2008 | O'Malley | |
| 7,422,069 | B2 | 9/2008 | Richard et al. | |
| 7,441,596 | B2 | 10/2008 | Wood et al. | |
| 7,475,729 | B2 | 1/2009 | Johnson | |
| 7,604,055 | B2 | 10/2009 | Richard et al. | |
| 7,699,101 | B2 * | 4/2010 | Fripp et al. | 166/229 |
| 2004/0079535 | A1 | 4/2004 | Richard et al. | |
| 2006/0048939 | A1 * | 3/2006 | Johnson | 166/285 |
| 2006/0124310 | A1 * | 6/2006 | Lopez de Cardenas et al. | 166/313 |
| 2007/0107908 | A1 | 5/2007 | Vaidya et al. | |
| 2008/0035349 | A1 | 2/2008 | Richard | |
| 2008/0121390 | A1 | 5/2008 | O'Malley et al. | |

OTHER PUBLICATIONS

Coronado, Martin P., et al., "Development of a One-Trip ECP Cement Inflation and Stage Cementing System for Open Hole Completions", IADC/SPE 39345, Mar. 1998, 473-481.

Henriksen, K.H., et al., "Integration of New Open Hole Zonal Isolation Technology Contributes to Improved Reserve Recovery and Revision in Industry Best Practices", SPE 97614, Dec. 2005, 1-6.

Garfield, G., et al., "Novel Completion Technology Eliminates Formation Damage and Reduced Rig Time in Sand Control Applications", SPE 93518, Mar. 2005, 1-5.

Garfield G., "New One-Trip Sand-Control Completion System That Eliminates Formation Damage Resulting From Conventional Perforating and Gravel-Packing Operations", SPE 96660, Oct. 2005, 1-5.

McElfresh, P., et al. "Maximizing Inflow Performance in Soft Sand Completions Using New One-Trip Sand Control Liner Completion Technology", SPE 94622. May 2005, 1-5.

* cited by examiner

METHOD AND SYSTEM FOR HYDRAULIC FRACTURING

PRIORITY INFORMATION

This application claims priority to, and is a continuation-in-part application of, U.S. application Ser. No. 12/425,983, filed on Apr. 17, 2009, the disclosure of which is incorporated herein by reference.

FIELD OF THE INVENTION

The present invention relates to a system and method for fracturing an underground formation in an oil or gas well.

BACKGROUND OF THE INVENTION

There are two commonly used techniques to fracture in a completion method. FIG. 1 shows a borehole 10 that has a casing string 12 that is cemented 14 in the surrounding annulus 16. This is normally done through a cementing shoe (not shown) at the lower end of the casing string 12. In many cases if further drilling is contemplated, the shoe is milled out and further drilling progresses. After the string 12 is cemented and the cement 14 sets a perforating gun (not shown) is run in and fired to make perforations 18 that are then fractured with fluid delivered from the surface followed by installation and setting of packer or bridge plug 20 to isolate perforations 18. After that the process is repeated where the gun perforates followed by fracturing and followed by setting yet another packer or bridge plug above the recently made and fractured perforations. In sequence, perforation and packer/bridge plug pairs 22, 24; 26, 28; 30, 32; and 34 are put in place in the well 10 working from the bottom 36 toward the well surface 38.

A variation of this scheme is to eliminate the perforation by putting into the casing wall telescoping members that can be selectively extended through the cement before the cement sets to create passages into the formation and to bridge the cemented annulus. The use of extendable members to replace the perforation process is illustrated in U.S. Pat. No. 4,475,729. Once the members are extended, the annulus is cemented and the filtered passages are opened through the extending members so that in this particular case the well can be used in injection service. While the perforating is eliminated with the extendable members, the cost of a cementing job plus rig time can be very high and in some locations the logistical complications of the well site can add to the cost.

More recently, external packers that swell in well fluids or that otherwise can be set such as 40, 42, 44, 46, and 48 in FIG. 2 can be set on the exterior of the string 49 to isolate zones 50, 52, 54, and 56 where there is a valve, typically a sliding sleeve 58, 60, 62 and 64 in the respective zones. The string 49 is hung off the casing 66 and is capped at its lower end 67. Using a variety of known devices for shifting the sleeves, they can be opened in any desired order so that the annular spaces 68, 70, 72 and 74 can be isolated between two packers so that pressurized frac fluid can be delivered into the annular space and still direct pressure into the surrounding formation. This method of fracturing involves proper packer placement when making up the string and delays to allow the packers to swell to isolate the zones. There are also potential uncertainties as to whether all the packers have attained a seal so that the developed pressure in the string is reliably going to the intended zone with the pressure delivered into the string 49 at the surface. Some examples of swelling packer are U.S. Pat. Nos. 7,441,596; 7,392,841 and 7,387,158. There are also potential uncertainties as to the location of the fracture with the possibility of fractures initiating at the packers instead of the valve.

SUMMARY OF THE INVENTION

According to one aspect of the present disclosure, there is provided a method to pinpoint the applied frac pressure to the desired formation while dispensing with or reducing expensive procedures such as cementing and annulus packers where the formation characteristics are such as that the hole will retain its integrity. The pressure in the string is delivered through extendable conduits that sealingly engage the formation. A plurality of banks of conduits are coupled with an isolation device so that only the bank or banks in interest that are to be fractured at any given time are selectively open. The delivered pressure through the extended conduits goes right to the formation and bypasses the annular space in between.

In one embodiment, the method comprises the steps of placing a portion of a conduit into a well bore, where the conduit has a plurality of extendable members and blocking at least a portion of an opening of the extendable members with a plurality of degradable plugs. The method further includes the steps of extending at least one of extendable member from said conduit, where at least a portion of a leading end of the extendable member engages a portion of a surrounding formation; and delivering pressurized fluid through the extendable member to push at least a portion of the degradable plugs onto the surrounding formation; and fracturing the surrounding formation with pressurized fluid delivered through the extendable member.

In another embodiment, the degradable plugs are configured to completely block the opening of said extendable members. In another embodiment, the method further comprises the step of sealing a gap between the leading end of the extendable member and the surrounding formation with the portion of degradable plugs that have been pushed onto the formation.

In another embodiment, the method further comprises the step of providing control of fluid access between the conduit and the surrounding formation through the opening of the extendable members. In one embodiment, the control is achieved with a plurality of sliding sleeves. In another embodiment, the method further comprises the step of opening at least one sliding sleeve to deliver pressurized fluid to the extendable members associated with said open sliding sleeve. In yet another embodiment, the method comprises the steps of closing the opened sliding sleeve and sequentially opening and closing other sliding sleeves to deliver fluid through an opening of the extendable members associated with the other sliding sleeves.

According to another aspect of the present disclosure, there is provided a system to perform fracturing operation in an open hole without cementing or similar annular space isolation procedures. The annular space of the system is spanned by extendable members that are located behind isolation valves. A given bank of extendable members can be uncovered and the extendable members extended to span the annular space and engage the formation in a sealing manner. The extendable members can be telescoping members and comprise a biodegradable plug that is configured to temporarily block the opening of the extendable members to allow extension of the extendable members to the surface of the formation by application of pressure flowing to the telescoping member, thereby creating a telescoped passage to the formation. With the extendable members engaged with the formation and the plug remained in place, additional pressure through pressurized fracturing fluid can be delivered to the plugged extendable members until at least a portion of the degradable material is pushed onto the surface of the formation. At least a portion of the degradable material forced onto the surface of the formation helps to seal between the end of the extendable members and the surface of the formation by filling any existing leak paths. The seal allows pressure to build until the formation frac gradient is exceeded and the formation is fraced at the telescoping member interface, thereby ensuring pinpoint placement of the fracture initiation. In a proper formation, cementing is not needed to maintain wellbore integrity. The extendable members can optionally have screens. Normally, the nature of the formation is such that gravel packing is also not required. A production string can be inserted into the string with the telescoping devices and the formation portions of interest can be produced through the selectively exposed extendable members.

In one embodiment, the extendable member comprises a degradable material. In another embodiment, the extendable member comprises a plurality of telescoping components. In another embodiment, the system further comprises at least one sliding sleeve configured to control fluid access between the conduit and the surrounding formation through said extendable member. In one embodiment, the sliding sleeve is configured to control fluid access through said extendable member in response to receiving an object of specified dimension.

In one embodiment, the system is configured to perform fracturing operation without packers. Alternatively, the system can be configured to perform fracturing operation with some packers placed between extended extendable members.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE PREFERRED EMBODIMENT

Figure 3:
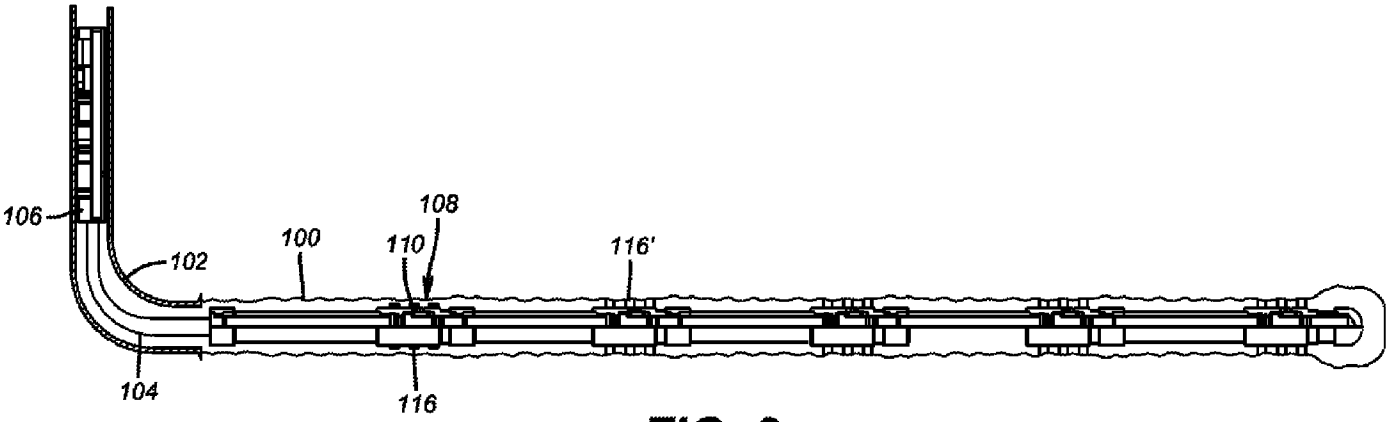
FIG. 3 shows an embodiment of the present invention using passages into the formation formed by extendable members that are selectively accessed with a valve so that the formation can be fractured directly from the string while bypassing the annular open hole space.

FIG. 3 illustrates an open hole 100 below a casing 102. A liner 104 is hung off casing 102 using a liner hanger 106. A fracturing assembly 108 is typical of the others illustrated in the FIG. 3 and those skilled in the art will appreciate that any number of assemblies 108 can be used which are for the most part similar but can be varied to accommodate actuation in a desired sequence as will be explained below. As shown in FIG. 4 each assembly 108 has a closure device that is preferably a sliding sleeve 110 that can be optionally operable with a ball 114 landing on a seat 112. In one embodiment, the seats and balls that land on them are all different sizes and the sleeves can be closed in a bottom up sequence by first landing smaller balls on smaller seats that are on the lower assemblies 108 and progressively dropping larger balls that will land on different seats to close the valve 110.

Figure 4A:
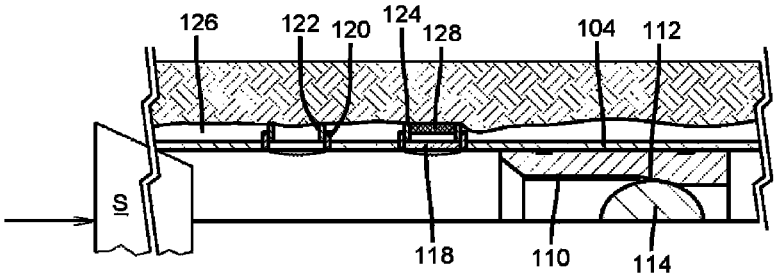
FIG. 4*a* shows extendable members comprising telescoping members in a retracted position and FIG. 4*b* shows the telescoping members in an extended position forming telescoping passages.
Figure 4B:
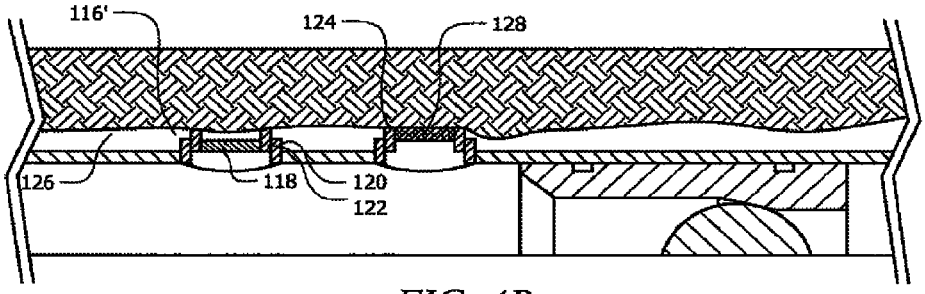

The array of extendable members 116 can comprise telescoping components, such as telescoping components or extensions 120 and 122, through which the members 116 can be extended. The extendable members 116 are selectively covered by a valve 110 that can be in any number or array or size as needed in the application for the expected flow rates for fracturing or subsequent production. FIGS. 3 and 4*a* show the extendable member 116 in the retracted position. In particular, FIG. 4*a* shows a closer view of expandable members 116 in the retracted position. FIG. 3 also shows extendable members 116' in the extended position against the borehole wall 100. FIG. 4*b* shows a closer view of extendable members 116' in the extended position. While the figures, e.g., 4*a* and 4*b*, only show extendable members 116 comprising two telescoping extensions or components, it should be understood that an extendable assembly can comprise the appropriate number of relatively moving components that are needed for the operation. For instance, the width of the annular gap 126 may dictate this number or other factors.

In the preferred embodiment, most or all the extendable members 116 are initially obstructed with a plug 118 so that the extendable members 116 can be extended by applying an internal pressure in the liner 104. The polymer plugs 118 at least substantially block or close the opening of the extendable members 116, thereby allowing the members to be extended when valves 110 at each assembly 116 is opened and pressure is applied, e.g., from liner 104. Further, in some embodiments, the plugs 118 fill the leak paths or gaps between the extendable members 116 and the formation, thereby improving the sealing engagement at the extendable assembly interface and ensuring pinpoint placement of the fracturing pressure. While the material of the plugs 118 are described in detail below, it should be understood that variations by way of substitutions and alterations from these descriptions do not depart from the spirit and scope of the invention and are understood to be within the scope of the invention. For instance, any polymer or material with similar properties as those described below can be used instead of or in combination with the materials described to achieve the functions of plug 118.

In the preferred embodiment, plug 118 is degradable. By having the degradable plug 118 closing or at least partially blocking the opening of the extendable members 116, the system and method of the present invention ensure that the extendable members fully extend and engage with the formation. Because the surface of the formation is not always smooth, it is likely that not all portions of the circumference of the engaging end of a fully extended telescoping member contact the surface of the formation. Consequently, a fully extended telescoping member may not provide an optimal pressure seal for fracturing operations, e.g., delivery of fracturing fluids through the telescoping passages to frac the formation at or near the point of contact. As such, the degradable material of the method and system of the present invention seals one or more of the gaps between the extended telescoping member and the formation, ensuring an adequate pressure seal for the fracturing operation and pinpoint placement of the applied pressure.

Figure 6:
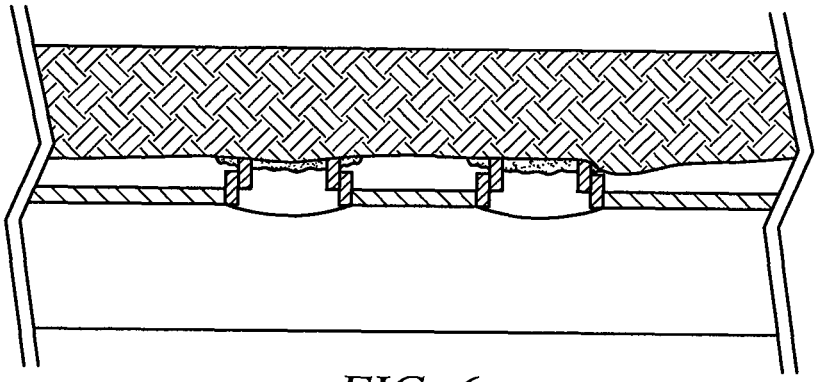
FIG. 6 shows a portion of the plug in the extendable members that has been pushed onto the surface of the formation to ensure a sealing engagement between the extendable members and the formation.

In one embodiment, once all the extendable members are extended and passages are formed, the plugs 118 remain substantially in place as the pressure delivered to the plugged extendable members is increased until at least a portion of the plug 118 is pushed or forced onto the surface of the formation by the increased pressure, as shown in FIG. 6. When at least a portion of the degradable material forced onto the surface of the formation, the degradable material improves the seal of the engagement between the end of the extendable members and the formation surface by filling the leak paths at or near the engagement interface, thereby allowing pressure to build until the formation frac gradient is exceeded and the formation is fraced.

In addition, the degradable material from the plug 118 that is pushed onto a surface of the formation further ensures the seal between the extendable members and the formation is maintained after the formation is fraced. In particular, the degradable material prevents loss of pressurized fluid into the annular space through the gaps, e.g. leak paths, between the extended telescoping member and the formation. As such, the degradable material maintains the seal, prevents further widening of the gaps through erosion, and ensures that there is sufficient pressure to extend the fracture. In addition, when the fracturing of the formation likely pushes some of the degradable material into the formation. Because the material is configured to degrade, as described below, it will not inhibit or pose any problems for future production or producing processes. In one embodiment, the degradable material is environmentally friendly, e.g., biodegradable, and does not substantially harm the environment.

In one embodiment, at least some or all of the components of the extendable members comprise a degradable material as described above. Preferably, the degradable material selected for the components of the extendable material is configured to degrade or disappear over time, thereby removing the flow pathways formed by the extendable members that span the annulus and allowing for improved production of hydrocarbon from the formation.

Figure 5A:
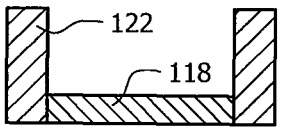
FIGS. 5*a*-5*f* show various placement configurations of a polymer plug in a telescoping member.
Figure 5B:
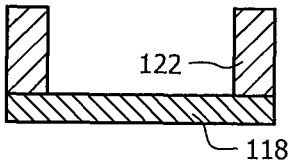
Figure 5C:
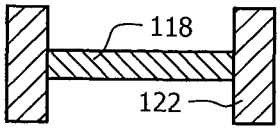
Figure 5D:
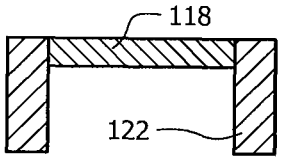
Figure 5E:
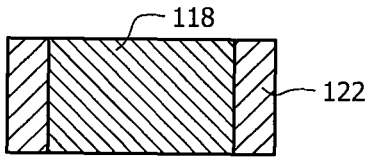
Figure 5F:
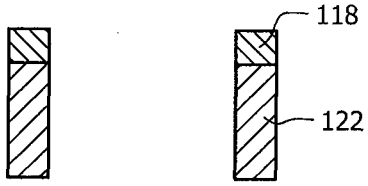

Referring to FIGS. 5*a*-5*f*, the plug 118 may be affixed to the extendable members 116, e.g., to telescoping component 122, to at least substantially block or close the opening of extendable members 116 in various configurations. For example, plug 118 may be affixed within the opening of extendable member at or around the end near liner 104 and away from the formation, as shown in FIG. 5*a*. In another embodiment, plug 118 may be affixed to cap the opening of the extendable members 116, as shown by FIG. 5*b*. While FIG. 5*b* shows that plug 118 caps component 122 of the extendable member 116 at the end away from the formation, it is envisioned that plug 118 can cap extendable member 116 at the end adjacent to the formation, alternatively or in combination, in other embodiments. In another embodiment plug 118 may be affixed to extendable member 116 within the opening of extendable assembly 116 between the two ends of the assembly, as shown in FIG. 5*c*. In another embodiment, plug 118 may be affixed within the opening of extendable assembly 116 at or around the leading end, as shown in FIG. 5*d*. In yet another embodiment, plug 118 may fill substantially the length of the opening of the assembly 116, as shown in FIG. 5*e*. It is envisioned that the configurations set forth in FIGS. 5*a*-5*e* can be used in various combinations. Further, in other embodiments, any one or the combination of the configurations shown in FIGS. 5*a*-5*e* can further comprise degradable material around the leading end of the component configured to engage the formation, e.g., 118 in FIG. 5*f*. With additional degradable material at the leading end, i.e., the end adjacent to the formation, the configuration of FIG. 5*f* further ensures that leak paths will be sealed when extendable members 116 engage the formation. In some embodiments, the plug 118 is affixed to the extendable assembly to substantially close or block the opening. For instance, there may be holes or gaps placed within the plugs. In one embodiment, the extendable members are configured to extend when pressure of about 1000 psi to about 5000 psi is applied. In other embodiments, it is envisioned that the extendable members can be configured to extend at other pressure ranges.

In one embodiment, the plugs 118 include or are at least partially made of a degradable material that degrades or disintegrates. As discussed above, the plugs material are designed to separate from the extendable members when certain pressures are applied to (1) provide a flow path through the extendable member, (2) provide an improved formation seal between the extendable member, and (3) enable pinpoint placement of the applied pressure to fracture the formation. Suitable degradable materials for the plugs 118 include, but are not necessarily limited to biodegradable polymers that degrade into acids. One such polymer is PLA (polylactide) polymer 4060D from NATURE-WORKS™, a division of Cargill Dow LLC. This polymer decomposes to lactic acid with time and temperature, which not only dissolves the filter cake trapped between the sleeve, tube or barrier and the borehole wall, but can stimulate the near flow pathway area of the formation as well. TLF-6267 polyglycolic acid from DuPont Specialty Chemicals is another polymer that degrades to glycolic acid with the same functionality. Other polyester materials such polycaprolactams and mixtures of PLA and PGA degrade in a similar manner and would provide similar filter cake removing functionality. Solid acids, for instance sulfamic acid, trichloroacetic acid, and citric acid, in non-limiting examples, held together with a wax or other suitable binder material would also be suitable. In the presence of a liquid and/or temperature the binder would be dissolved or melted and the solid acid particles liquefied and already in position to locally contact and remove the filter cake from the wellbore face and to acid stimulate the portion of the formation local to the flow pathway. Polyethylene homopolymers and paraffin waxes are also expected to be useful materials for the degradable barriers in the method of this invention. Products from the degradation of the barrier include, but are not necessarily limited to acids, bases, alcohols, carbon dioxide, combinations of these and the like.

There are other types of materials that can be used for plugs 118 and can be controllably removed. Polyalkylene oxides, such as polyethylene oxides, and polyalkylene glycols, such as polyethylene glycols, are some of the most widely used in other contexts. These polymers are slowly soluble in water. The rate or speed of solubility is dependent on the molecular weight of these polymers. Acceptable solubility rates can be achieved with a molecular weight range of 100,000 to 7,0000,000. Thus, solubility rates for a temperature range of 50 degrees C. to 200 degrees C. can be designed with the appropriate molecular weight or mixture of molecular weights. In addition to the materials provided, other suitable materials include degradable materials serving a variety of temporary plugging purposes downhole that are known in the art having different chemistries appropriate for various well conditions.

In one non-limiting embodiment of the invention, the degradable material degrades over a period of time ranging from about 1 to about 240 hours. In an alternative, non-limiting embodiment the period of time ranges from about 1 to about 120 hours, alternatively from 1 to 72 hours. In another non-limiting embodiment of the invention, the degradable material degrades over temperature range of from about 50 degrees C. to about 200 degrees C. In an alternative, non-limiting embodiment the temperature may range from about 50 degrees to about 150 degrees C. Alternatively, the lower limit of these ranges may be about 80 degrees C. Of course, it will be understood that both time and temperature can act together to degrade the material. And certainly the use of water, as is commonly used in drilling or completion fluids, or some other chemical, could be used alone or together with time and/or temperature to degrade the material. Other fluids or chemicals that may be used include, but are not necessarily limited to alcohols, mutual solvents, fuel oils such diesel, and the like. In the context of this invention, the degradable barrier is considered substantially soluble in the fluid if at least half of the barrier is soluble therein or dissolves therein.

In other embodiments, plugs 118 can further comprise a delayed degradation material layer that is similar to, but may be different than the degradable materials described. This may be because the delayed degradation material layer is expected in most cases to coat or be placed over the degradable plugs. One purpose of the delayed degradation material layer is to protect the tool and the degradable during run-in and placement of the tool. Some of the materials for the delayed degradation material layer may be the same as or different from those for the plugs 118.

The delayed degradation material layer may include, but is not necessarily limited to, polyurethane, saturated polyesters, polyvinyl alcohols, low molecular weight polyethylenes, polylactic acid, polyglycolic acid, cellulose, polyamides, polyacrylamides, polyketones, derivatized cellulose, medium and high molecular weight silicones, and combinations thereof. Derivatized cellulose is defined to include, but not necessarily limited to, carboxymethylcellulose (CMC), hydroxyethylcellulose (HEC), polyanionic cellulose (PAC), carboxy-methylhydroxyethylcellulose (CMHEC), and combinations thereof. Medium molecular weight silicones are defined as those having a weight average (M.sub.w) molecular weight of from about 10,000 to about 100,000, whereas high molecular weight silicones are defined as those having a weight average molecular weight of from about 100,000 to about 750,000. Particularly suitable low molecular weight polyethylenes include, but are not restricted to, POLYWAX® polyethylenes having a number average molecular weight of between about 450 and about 3000, available from Baker Petrolite.

Further, each or some of the members 116 can have a screen material 128 in the through passage that forms after extension of the members 116. The valve 110 associated with each telescoping assembly 116 can also be operated with a sleeve shifter tool in any desired order. Each valve can have a unique profile that can be engaged by a shifting tool on the same or in separate trips to expedite the fracturing with one valve 110 and its associated telescoping array 116 ready for fracturing or more than one valve 110 and telescoping array 116.

As another alternative for closing the valve 110 articulated ball seats can be used that accept a ball of a given diameter and allow the valve 110 to be operated and the ball to pass after moving the seat where such seat movement configures another seat in another valve 110 to form to accept another object that has the same diameter as the first dropped object and yet operate a different valve 110. Other techniques can be used to allow more than one valve to be operated in a single trip in the well. For example an articulated shifting tool can be run in and actuated so that on the way out or into the well it can open or close one or more than one valve either based on unique engagement profiles at each valve, which is preferably a sliding sleeve or even with common shifting profiles using the known location of each valve and shifting tool actuation before reaching a specific valve that needs shifting.

Alternatively rupture discs set to break at different pressure ratings can be used to sequence which telescoping members will open at a given pressure and in a particular sequence. However, once a rupture disc is broken to open flow through a bank of telescoping members, those passages cannot be closed again when another set of discs are broken for access to another zone. With sliding sleeves all the available volume and pressure can be directed to a predetermined bank of passages but with rupture discs there is less versatility if particular zones are to be fractured in isolation.

Figure 1:
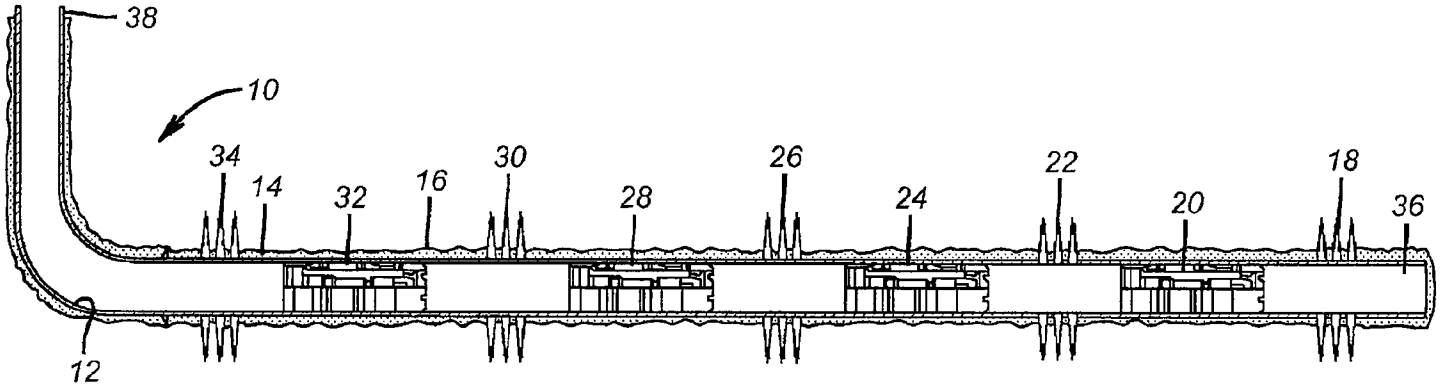
(PRIOR ART) FIG. 1
FIG. 1 is a prior art system of cementing a casing and sequentially perforating and setting internal packers or bridge plugs to isolate the zones as they are perforated and fractured.
Figure 2:
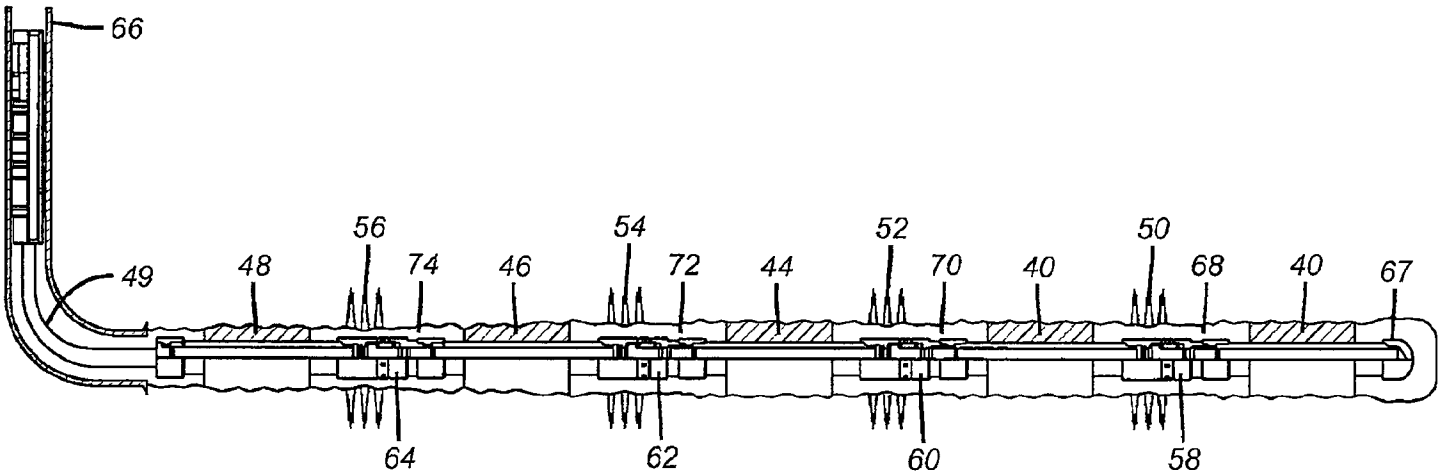
(PRIOR ART) FIG. 2
FIG. 2 is another prior art system using external swelling packers in the annular space to isolate zones that are accessible with a sliding sleeve valve.

The method of the present invention allows fracturing in open hole with direction of the fracture fluid into the formation without the need for annular barriers and in a proper formation the fracturing can take place in open hole without cementing the liner. Such a technique in combination with valves at most or all of the telescoping members allows the fracturing to pin down in the needed locations and in the desired order. After fracturing, some or all the valves can be closed to either shut in the whole well where fracturing took place or to selectively open one or more locations for production through the liner and into a production string (not shown). The resulting method saves the cost of cementing and the cost of annulus barriers and allows the entire process to the point of the fracturing job to be done in less time than the prior methods such as those described in FIGS. 1 and 2.

While telescoping members are discussed as the preferred embodiment other designs are envisioned that can effectively span the gap of the surrounding annulus in a manner to engage the formation in a manner that facilitates pressure transmission and reduces pressure or fluid loss into the surrounding annulus. Those skilled in the art will appreciate that this method is focused on well consolidated formations where hole collapse is not a significant issue.

Figure 8A:
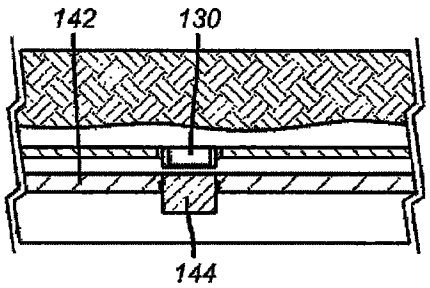
FIG. 8*a* shows a telescoping member and an extendable device of a running string that is configured to extend the telescoping member in an initial position.
Figure 8B:
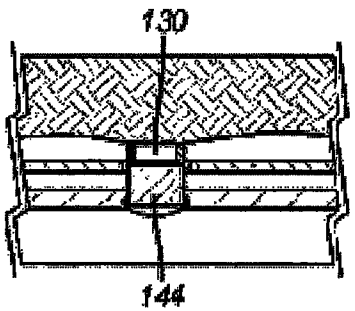
FIG. 8*b* shows the telescoping member extended with the extendable device of the running string.
Figure 7A:
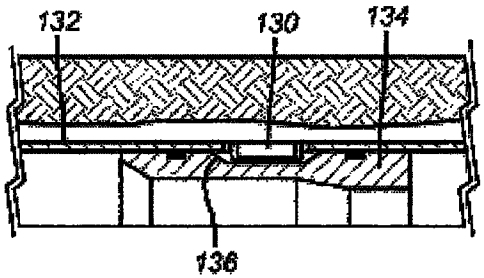
FIG. 7*a* shows a telescoping member and sliding sleeve in an initial position and FIG. 7*b* shows the telescoping member extended with the sliding sleeve opened.
Figure 7B:
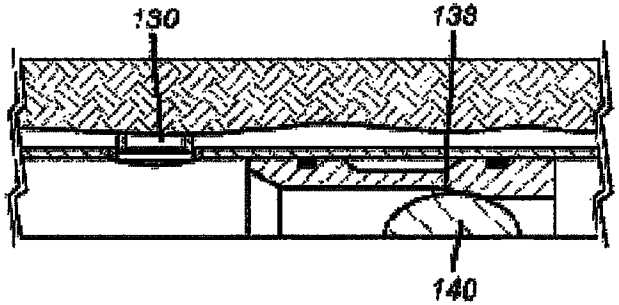

One alternative to extending the members 116 hydraulically is to do it mechanically. As shown as 130 in FIG. 7*a*, the telescoping units are retracted into the casing so as not to extend beyond its outside diameter 132 when installed. When sliding sleeve 134 shifts in FIG. 7*b*, such as when ball 138 lands on seat 140 the sliding sleeve 134 has a taper 136 which applies mechanical force onto the telescoping units 130 and extends them to touch the formation as shown as 131. Although a sliding sleeve is preferred, any mechanical devices can be used to mechanically extend the telescoping units. One example, shown in FIGS. 8*a* and 8*b*, is to use a running string 142 with collapsible pushers 144 to push out the telescoping units as shown in FIGS. 8*a* and 8*b*. The pushers can be extended with internal pressure or by another means. In this case, a closure device is optional.

Another alternative to pushing out the members 116 with pressure using telescoping components is to incorporate expansion of the liner 104 to get the members to the surrounding formation. This can be with a combination of a telescoping assembly coupled with tubular expansion. The expansion of the liner can be with a swage whose progress drives out the members that can be internal to the liner 104 during run in. Alternatively, the expansion can be done with pressure that not only expands the liner but also extends the members 116.

Optionally, the leading ends of the outermost telescoping segment 122 can be made hard and sharp such as with carbide or diamond inserts to assist in penetration into the formation as well as sealing against it. The leading end can be castellated or contain other patterns of points to aid in penetration into the formation.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for fracturing a formation comprising the steps of:

placing a conduit into a non-cemented well bore, said conduit comprises a plurality of radially extendable members, each with a passageway extending radial to the conduit and axial to the extendable member, blocking at least a portion of the passageway of each extendable member with a degradable plug;

extending at least one of said plurality of extendable members from said conduit, wherein at least a portion of a leading end of said at least one extendable member engages a portion of a surrounding formation;

delivering pressurized fluid to the passageway of said at least one extendable member to push at least a portion of said degradable plug onto said surrounding formation; and fracturing said surrounding formation with pressurized fluid delivered through the passageway of said at least one extendable member.

2. The method of claim 1 further comprising the step of:

sealing a gap between said leading end of said at least one extendable member and said portion of the surrounding formation with said pushed portion of said degradable plug.

3. The method of claim 1 wherein said degradable plugs are configured to completely block the passageway of said extendable members.

4. The method of claim 1 further comprising the step of:

providing control of fluid access between the conduit and the surrounding formation through the passageways of said extendable members.

5. The method of claim 4 wherein said control is achieved with a plurality of sliding sleeves.

6. The method of claim 1 further comprising the step of:

removing said extended extendable member to provide a fluid path between said surrounding formation and an annular space around said conduit for production.

7. The method of claim 6 further comprising the steps of:

opening at least one sliding sleeve to deliver pressurized fluid to the extendable members associated with said open sliding sleeve.

8. The method of claim 7 further comprising the steps of:

closing said open sliding sleeve; and sequentially opening and closing other sliding sleeves to deliver pressurized fluid through the passageways of extendable members associated with said other sliding sleeves.

9. The method of claim 1 wherein said extending at least one extendable member is achieved by delivering pressure to said blocked passageway of said at least one extendable member.

10. The method of claim 1 further comprising the step of:

placing a packer between two extended extendable members.

11. A formation fracturing system, comprising a conduit for fracturing a formation comprising at least one extendable member, said extendable member comprises a passageway extending radial to the conduit and axial to the extendable member, wherein said extendable member is configured to extend generally radially outward from said conduit to contact a borehole wall of a non-cemented well bore; and a degradable plug configured to block a portion of the passageway of said extendable member, wherein at least a portion of said plug is within said extendable member.

12. The system of claim 11 wherein said degradable plug is configured to separate from said extendable member when a pressure applied to said substantially blocked extendable member exceeds a threshold.

13. The system of claim 12 further comprising at least one sliding sleeve configured to control fluid access between the conduit and the surrounding formation through the passageway of said extendable member.

14. The system of claim 12 wherein said extendable members are configured to engage a surrounding formation when extended.

15. The system of claim 12 wherein said extendable members are configured to extend when a pressure is applied.

16. The system of claim 11 wherein said extendable member comprises a degradable material.

17. The system of claim 11 wherein said extendable member comprises a plurality of telescoping components.

18. The system of claim 17 wherein said sliding sleeve is configured to control fluid access in response to receiving an object of specified dimension.

19. The system of claim 11 wherein said degradable plug is configured to completely block the passageway of said extendable member.

20. The system of claim 11 further comprising at least one packer placed between two extended extendable members.

* * * * *